United States Patent [19]

Matthews

[11] Patent Number: 4,495,868

[45] Date of Patent: Jan. 29, 1985

[54] SAFE FIRECRACKER

[76] Inventor: Johnnie V. Matthews, P.O. Box 1171, East Orange, N.J. 07018

[21] Appl. No.: 348,920

[22] Filed: Feb. 16, 1982

[51] Int. Cl.[3] ..... F42B 4/04; F42B 4/22; F42B 4/24

[52] U.S. Cl. ..... 102/357; 102/342; 102/345; 102/360; 102/361

[58] Field of Search ..... 102/342, 345, 357, 360, 102/361

[56] References Cited

U.S. PATENT DOCUMENTS

| | | | |
|---|---|---|---|
| 1,761,820 | 6/1930 | Fabrizio | 102/361 |
| 2,086,618 | 7/1937 | Hitt | 102/361 |

*Primary Examiner*—Charles T. Jordan
*Assistant Examiner*—Ted L. Parr

[57] ABSTRACT

There is disclosed a firecracker assembly comprising a casing member; and a firecracker member in the casing member. The firecracker member including a first powder portion and a first fuse attached thereto extending through the firecracker member and a second powder portion and a second fuse attached to said firecracker member, wherein the firecracker member is propelled out of the casing member.

13 Claims, 4 Drawing Figures

SAFE FIRECRACKER

FIELD OF THE INVENTION

This invention relates to a firecracker assembly and more particularly to a safe firecracker assembly.

BACKGROUND OF THE INVENTION

During the times of the year when firecrackers are in widespread use, newspapers and the electronic media report numerous instances when such use causes innumerable injuries. These injuries afflict both the actual user of the firecracker or people in the surrounding area where the firecracker is exploded. Reported accidents include injuries such as severe burns, loss of parts of the body, and blindness.

Each year local enforcement agencies attempt to limit the use of firecrackers but they are not always successful. Children and young adults still have the ability to acquire firecrackers even though their possession may be unlawful in a number of states.

OBJECTS OF THE INVENTION

It is an object of the present invention to provide a novel firecracker assembly.

Another object of the present invention is to provide a novel firecracker assembly that is safe to use.

A further object of the present invention is to provide a novel firecracker assembly that will not explode in the user's hand.

Yet another object of the present invention is to provide a novel firecracker assembly with a self-propelling feature.

Still another object of the present invention is to provide a novel firecracker assembly that does not present a danger to small children.

Still another object of the present invention is to provide a novel firecracker assembly that has a self-extinguishing feature.

Further another object of the present invention is to provide a novel firecracker assembly that will eliminate bodily injury or harm to the user or anyone in the surrounding area during its use.

Still another object of the present invention is to provide a novel firecracker assembly that becomes totally unfunctional if tampered with.

Still further another object of the present invention is to provide a novel firecracker assembly that is stable because of its rectangular shape.

SUMMARY OF THE INVENTION

These and other objects of the present invention are achieved by a novel firecracker assembly comprising a casing member; and a firecracker member positioned in the casing member, the firecracker member including a first powder portion and a first fuse attached thereto extending through the firecracker member and the casing member, a second powder portion and a second fuse attached thereto, and a chamber having a bottle member containing a liquid for soaking the second powder portion and the second fuse disposed in the chamber upon release of the liquid.

BRIEF DESCRIPTION OF THE DRAWINGS

A better understanding of the present invention as well as other objects and advantages thereof, will become apparent upon consideration of the detailed disclosure thereof, especially when taken with the accompanying drawings, wherein.

DETAILED DESCRIPTION OF THE INVENTION

Figure 1:
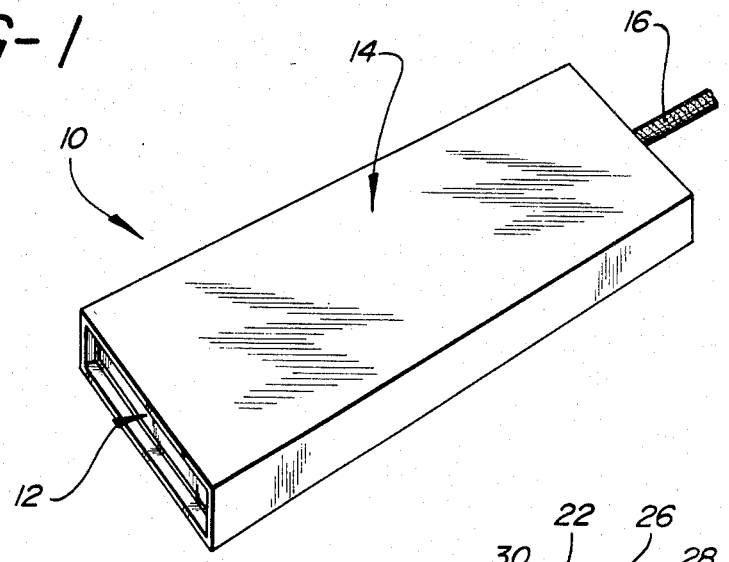
FIG. 1 is perspective view of the firecracker assembly of the present invention.

Referring now to FIG. 1, there is shown a firecracker assembly, generally indicated as 10, comprised of a firecracker portion 12 positioned within a casing portion 14. Arising out of firecracker portion 12 is an outer fuse 16 which extends through casing portion 14.

Figure 2:
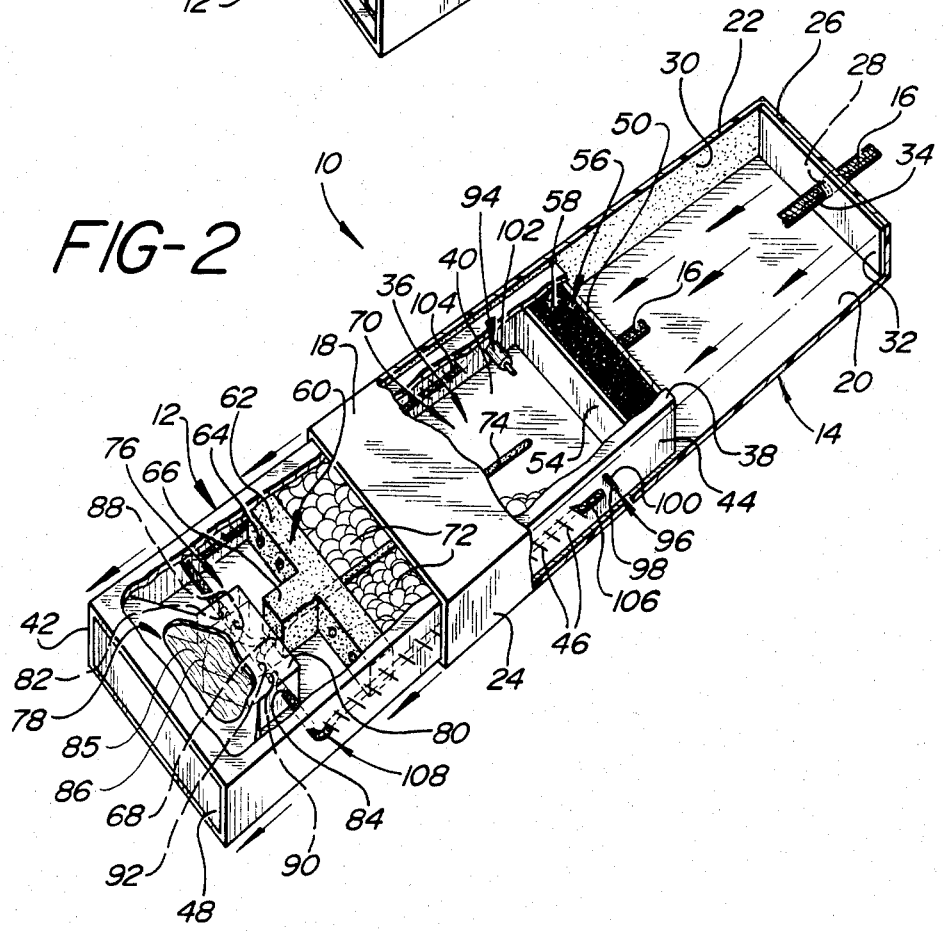
FIG. 2 is a perspective cut-away view of the firecracker assembly of the present invention in the initial exiting stage of operation.
Figure 3:
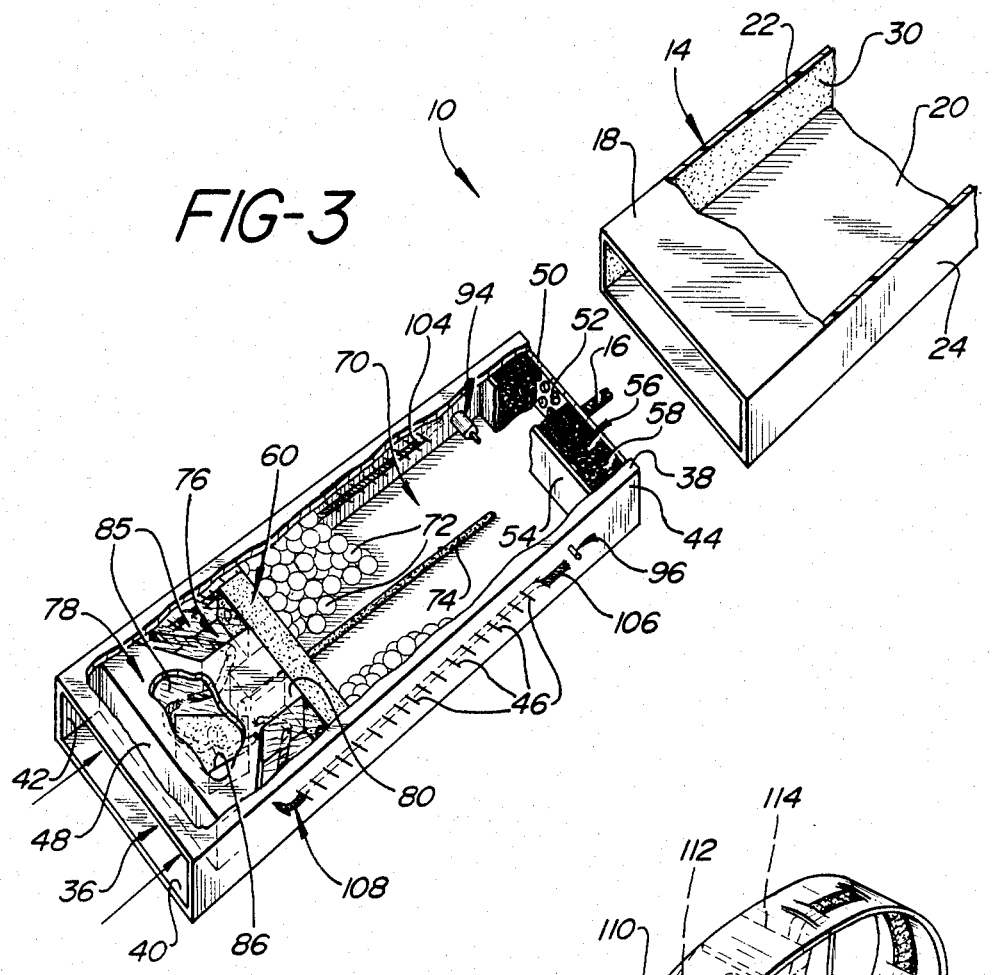
FIG. 3 is a perspective cut away view of the firecracker assembly of the present invention at a time subsequent to FIG. 2.

Referring now to FIGS. 2 and 3, there is shown in more detail firecracker assembly 10. Casing portion 14, preferably constructed of plastic, is rectangular in shape and comprised of a top and bottom wall, 18 and 20 respectively, side walls, 22 and 24 respectively and an end wall 26 with an orifice 28 for positioning the outwardly directed fuse 16. On the side walls, 22 and 24 within said casing portion 14 there are mounted panels of abrasive material 30. Additionally, on end wall 26 within said casing portion 14 there is mounted a foil panel with putty extinguishing solution insulation, generally indicated as 32 having an orifice 34 to reduce heat transfer as more fully hereinafter detailed. The putty extinguishing solution is made up of glue, vinegar and bicarbonate of soda.

Firecracker portion 12 is a rectangular in shape receptacle 36 defined by a top and bottom wall, 38 and 40 respectively, side walls, 42 and 44 respectively, each having a plurality of slits 46 and end wall 48 and end wall 50 having a plurality of orifices 52. Within said receptacle 36 there is positioned an intermediate wall 54 cooperatively forming with end wall 50 a first chamber 56 for containing black powder 58 and outer fuse 16.

Spaced away from intermediate wall 54 within said receptacle 36 is a T-shaped member 60 having a wall member 62 containing a plurality of escape holes 64, preferably constructed of cork, having a wall parallely disposed to said intermediate wall 54 and a perpendicularly disposed leg portion 66 disposed opposite from intermediate wall 54 having a channel 68. Intermediate wall 54 and said wall member 62 of T-shaped member 60 cooperatively define a second chamber 70 containing a plurality of capsules 72 containing an extinguishing solution, such as water, and a gunpowder trail 74 arising therein and extending into said perpendicularly disposed leg portion 66 through channel 68.

Wall member 62 and perpendicularly disposed leg portion 66 in combination with end wall 48 cooperatively define a third chamber 76, wherein there is disposed a solution container 78 having a neck portion 80 with oppositely aligned orifices 82 and 84 respectively and containing an extinguishing solution 85. Positionable within said neck portion 80 and abuttable to said perpendicularly disposed leg portion 66 of T-shaped member 60 is container stopper 86, preferably made of cork, having orifices 88 and 90 in alignment with orifices 82 and 84 on neck portion 80. Orifices 88 and 90 meet within said container stopper 86 and form a central canal 92 in communication with channel 68 of said perpendicularly disposed leg portion 66.

Positioned on said side walls 42 and 44 in close proximity to intermediate wall 54 and extending into said second chamber 70 are lighter assemblies, 94 and 96 respectively. Said lighter assemblies 94 and 96 are comprised of a match head 98, extending through said side walls 42 and 44, and a match body 100 having a putty-jacket 102 extending within said second chamber 70. Abutting said match heads 98 are fuses, 104 and 106 respectively which enter the closest slits 46 and travel along side walls 42 and 44 whereupon reaching said third chamber 76 are insertable within orifices 82 and 84 of neck portion 80 of solution container 78 and aligned orifices 88 and 90 of container stopper 86 meeting and joining at central canal 92 to form one fuse 108 and to communicate with said gunpowder trail 74 in channel 68 in perpendicular disposed leg portion 66 of T-shaped member 60.

Figure 4:
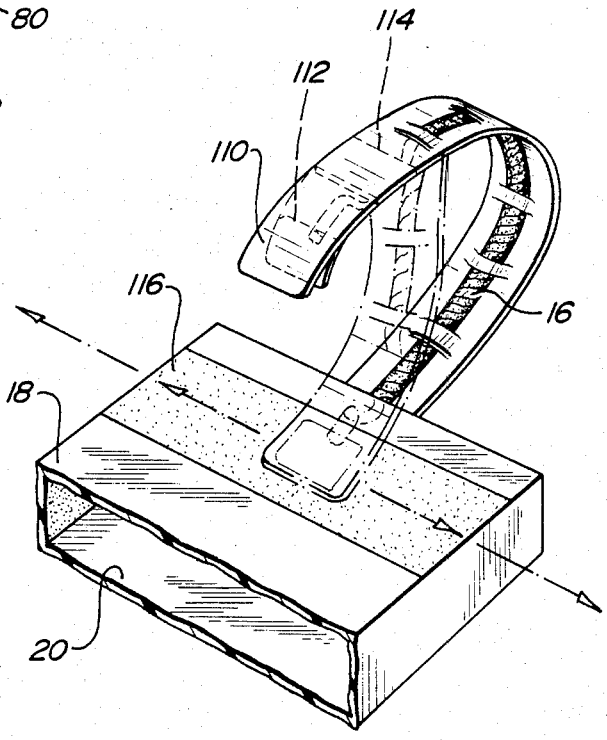
FIG. 4 is a partial cut-away view of another embodiment of the firecracker assembly.

Referring now to FIG. 4, rather than needing an independent flame source to ignite outwardly directed fuse 16, the flame source can be self-contained, whereby fuse 16 is contained on a shield strip device 110 having a match head 112 located adjacent to the fuse 16 and a putty extinguishing strip 114. Additionally, located on said top or bottom wall 18 and 20 of casing portion 14 is a strip of abrasive material 116 whereby the match head on said shield strip device 110 can be rubbed on said strip of abrasive material 116 causing said match head 112 to ignite and thereby igniting fuse 16. Putty extinguishing strip 114 is positioned to prevent said match head 112 from continuing to burn after said fuse 16 is ignited.

In normal operation, the user of firecracker assembly 10 ignites outwardly directed fuse 16 thereby causing fuse 16 to burn through orifice 28 of casing portion 14 into first chamber 56 contacting and igniting black powder 58. Upon igniting black powder 58 gases are formed in first chamber 56 escaping through said plurality of orifices 52 on end wall 50 of firecracker portion 12 causing said firecracker portion 12 to be propelled out of casing portion 14. The propelling motion causes match heads 98 on side walls 42 and 44 to contact said panels of abrasive material 30 on side walls 22 and 24 of casing 14 causing said match heads 98 to ignite thereby lighting the abutting fuses 104 and 106. Fuses 104 and 106 proceed to burn along side walls 42 and 44 supported by air entering through slits 46 and continue to burn through orifices 82 and 84 of neck portion 80 and orifices 88 and 90 of container stopper 86 meeting at central canal 92 and continuing to burn single fuse 108 until fuse 108 contacts gunpowder trail 74 in channel 68 in perpendicularly disposed leg portion 66 of T-shaped member 60 causing said firecracker portion 12 to explode.

The novelty of said firecracker assembly 10 is not only in its construction but also the numerous safety devices that are found therein. Such safety devices are to prevent those users who are malicious or careless from hurting third persons or themselves.

Initially, the operation of firecracker assembly 10 leading to its explosion is a two stage process; that is, not only must outer fuse 16 be ignited, but firecracker portion 12 must be propelled out of casing portion 14 to ignite fuses 104 and 106, which in turn contact gunpowder trail 74 causing said firecracker portion 12 to explode. Therefore, after outer fuse 16 is ignited and a user attempts to stop firecracker portion 12 from being propelled out of casing portion 14, firecracker assembly 10 will still not explode since fuses 104 and 106 leading to the gunpowder trail 74 cannot be ignited unless firecracker portion 12 is propelled out of casing portion 14.

Another safety factor is the presence of plurality of capsules 72 located in the second chamber 70 within firecracker portion 12 whereby if a user or a child compresses firecracker portion 12 after it has been propelled out of the casing portion 14, the pressure will cause the capsules 72 to erupt or burst, thereby releasing the extinguishing solution which will wet the gunpowder trail 74 and fuses 104 and 106 within second chamber 70 and third chamber 76 and prevent them from igniting.

A third safety factor involves the said solution container 78 and said container stopper 86. When said firecracker portion 12 is positioned within casing portion 14 or has been propelled out of casing portion 14, an individual can stop the exploding process by pushing in on end wall 48 of firecracker portion 12. The force on end wall 48 causes solution container 78 and container stopper 86 to move forward forcing the abutting perpendicularly disposed leg portion 66 of T-shaped member 60 to push container stopper 86 into solution container 78 thereby releasing extinguishing solution 85 from solution container 78 wetting gunpowder trail 74 and fuses 104 and 106 preventing an explosion. Additionally, the force on container stopper 86 causes fuses 104 and 106 to break.

Finally, these safety features are possible because firecracker portion 12 is a sophisticated, but yet simple device that is responsive to all aspects of safety to which it represents.

Numerous modifications and variations of the above disclosed invention are possible in light of the above teachings and, therefore, within the scope of the appended claims the invention may be practiced otherwise than as particularly described.

I claim:

1. A firecracker assembly, comprising:

a firecracker; a casing, said firecracker being positioned in the interior of said casing; propelling means for propelling the firecracker from said casing, said propelling means comprising a powder portion for releasing a propelling gas within the casing to propell the firecracker from the casing; a fuse means connected to the powder portion and extending to the exterior of the casing for igniting the powder portion; a firecracker fuse means within the casing for igniting the firecracker; and ignition means within the interior of the casing for igniting the firecracker fuse means upon propelling the firecracker from the casing, whereby igniting said fuse means ignites the powder means for propelling the firecracker from the casing, said propelling causing the ignition means to ignite the firecracker fuse means whereby the firecracker exploded outside of said casing.

2. The firecracker assembly of claim 1 and further comprising:

at least one container means within the firecracker, said at least one container means containing a liquid for wetting the firecracker to prevent explosion thereof, said at least one container means releasing said liquid by application of pressure to said container means.

3. The firecracker assembly of claim 2 wherein said container means is a breakable container means.

4. The firecracker assembly of claim 2 wherein said container means include a closure means which is opened by application of pressure.

5. The firecracker assembly of claim 2 wherein the ignition means is comprised of at least one match head and an abrasive material, said abrasive material being positioned on an interior wall of said casing and said match head being positioned on an exterior wall of said firecracker in contact with the abrasive material, whereby the match is ignited by scraping against the abrasive material upon propelling the firecracker from the casing.

6. The firecracker assembly of claim 2 wherein the firecracker includes at least two chambers, one of said at least two chambers including said powder portion for releasing a propelling gas, and the other of said at least two chambers including said container means and powder for exploding the firecracker.

7. A firecracker assembly comprising:

a casing member; and a firecracker member positioned in said casing member, said firecracker member including a first powder portion and a first fuse attached thereto extending to the exterior of said casing member, a second powder portion and a second fuse attached thereto, and a first chamber having a container member containing a liquid for soaking said second powder portion and said second fuse upon release of the liquid from the container member.

8. The firecracker assembly as defined in claim 7 wherein said casing member is comprised of a top wall, a bottom wall, an end wall and side wall, and means within said casing member for igniting said second fuse.

9. The firecracker assembly as defined in claim 8 wherein said means for igniting said second fuse is comprised of at least one panel of an abrasive material mounted within said casing member on at least one of said walls of said casing member.

10. The firecracker assembly as defined in claim 9 wherein said means for igniting said second fuse is further comprised of at least one match head connected to the firecracker member in contact with said at least one panel of abrasive material.

11. The firecracker assembly as defined in claim 10 wherein said firecracker member is further comprised of a second chamber defined by an end wall having a plurality of orifices therein and an intermediate wall, said second chamber containing said first powder portion, said second chamber being positioned on an end of said firecracker member opposite said first chamber.

12. The firecracker assembly as defined in claim 11 wherein said firecracker member is further comprised of a third chamber intermediate to and defined by said first and second chambers, the third chamber containing said second powder portion and including a plurality of breakable containers for releasing liquid upon compression of said casing member for soaking said second powder portion and said second fuse.

13. The firecracker assembly as defined in claim 7, and further comprising a shield strip connected to the exterior of said casing, a portion of said first fuse being positioned in said shield strip; a match head on said shield strip adjacent to said first fuse for igniting said first fuse; and extinguishing strip positioned behind said match head to extinguish said match head after said first fuse is ignited.

* * * * *